US005108699A

United States Patent [19]

Bodnar et al.

[11] Patent Number: 5,108,699

[45] Date of Patent: Apr. 28, 1992

[54] MODIFIED 1% CRMOV ROTOR STEEL

[75] Inventors: Richard L. Bodnar, Bethlehem, Pa.; Robert I. Jaffee, Palo Alto, Calif.

[73] Assignee: Electric Power Research Institute, Palo Alto, Calif.

[21] Appl. No.: 620,132

[22] Filed: Nov. 30, 1990

Related U.S. Application Data

[63] Continuation-in-part of Ser. No. 260,245, Oct. 19, 1988, abandoned.

[51] Int. Cl.[5] ..... C22C 38/46; C22C 8/00

[52] U.S. Cl. ..... 420/109; 148/335; 148/12 F

[58] Field of Search ..... 420/109; 148/335, 144, 148/134, 12 F; 416/241 R; 60/909

[56] References Cited

FOREIGN PATENT DOCUMENTS

| | | | |
|---|---|---|---|
| 60-70166 | 4/1985 | Japan | 420/109 |
| 60-224766 | 10/1985 | Japan | 420/109 |
| 1009924 | 11/1965 | United Kingdom | 148/335 |

*Primary Examiner*—Deborah Yee

[57] ABSTRACT

A modified 1% CrMoV steel of particular use in steam and gas turbine rotors contains from about 0.20 percent to about 0.35 percent carbon, less than about 0.1 percent manganese, from about 1.5 percent to about 6.5 percent nickel, from about 0.8 percent to about 2.0 percent chromium, from about 0.9 percent to about 2.0 percent molybdenum, from about 0.1 percent to about 0.4 percent vanadium, from zero to about 0.07 percent columbium, less than about 0.12 percent silicon, less than about 0.006 percent phosphorus, less than about 0.002 percent sulfur, less than about 0.005 percent antimony, less than about 0.010 percent arsenic, less than about 0.010 percent tin, less than about 0.10 percent copper, less than about 0.010 percent aluminum, balance iron totalling 100 percent, with all percentages by weight. Selected compositions of this steel can be processed to have a 50% fracture appearance transition temperature of less than ambient temperature, and do not exhibit temper embrittlement after extended periods of elevated temperature exposure. The hardenability and creep rupture properties of the modified steel are better than, or equivalent to, those of the standard 1% CrMoV steels, which are brittle at ambient temperatures and subject to temper embrittlement.

19 Claims, 3 Drawing Sheets

MODIFIED 1% CRMOV ROTOR STEEL

This application is a continuation-in-part of application Ser. No. 07/260,245, filed Oct. 19, 1988 now abandoned, for which priority is claimed.

BACKGROUND OF THE INVENTION

This invention relates to steels, and, more particularly, to an improved 1%CrMoV steel useful in producing large turbine rotors for electrical power generation.

Most of the electrical power produced by utilities is generated using steam or gas turbines. To produce the steam used in the steam turbines, water is vaporized in a heat exchanger heated by the burning of coal or petroleum, or through a controlled nuclear reaction. The steam is directed into the steam turbine, which has a series of turbine blades (also known as buckets) arranged around the periphery of a wheel or rotor. The rotor turns on a shaft under the impact of the steam against the turbine blades. The shaft is connected to an electrical generator, so that electrical power is generated as the shaft turns.

There are many types of specialty materials used in the construction of such turbines used for power generation. The present invention is directed to an improvement in one of these materials, the steel used in rotor forgings. The rotor of a steam turbine used in power generation, which may be as large as 200 centimeters diameter at its low pressure end, turns on its shaft at a rate of 3600 revolutions per minute (for 60 cycle power generation, the standard in the United States), and the high pressure end typically operates at a temperature of up to about 565° C. These operating conditions are continued for thousands of hours in normal service. The material of construction of the rotor must be able to operate without failure under these conditions, with an acceptable margin of safety. The largest turbine rotors are among the largest one-piece forgings made in the world, and are very expensive. Improvements in the material of construction can have a major effect on the cost of electricity, the life of the powerplant between major overhauls, and the safety of the powerplant.

To meet these operating requirements, a specialty steel known as "1%CrMoV" steel has been developed and used over a period of many years. This steel has acceptable strength, creep resistance, resistance to notch sensitivity, and toughness, which are retained, at gradually reduced levels, during thousands of hours of operation of the rotor. The compositions of the 1%CrMoV steels are specified by ASTM standards A470 Class 8, as modified by supplements. Generally, the composition falls within the range 0.25–0.35 percent carbon, 1.0 percent maximum manganese, 0.15–0.35 percent silicon (with silicon below 0.10 percent permitted in some instances), 0.015 maximum phosphorus, 0.015 maximum sulfur, 0.75 percent maximum nickel, 0.90–1.50 chromium, 1.0–1.5 percent molybdenum, 0.20–0.30 percent vanadium, balance iron totalling 100 percent, with all percentages by weight.

Although the 1%CrMoV steel has proved to be highly effective in steam and gas turbine rotors now in service throughout the world, its use requires that special operating procedures be employed during startup and shutdown of the turbine. When the steel is given a conventional heat treatment of austenitizing at 950° C., fan cooling (or oil quenching in European practice), and tempering to a tensile strength at 790 MPa, the 50%

Fracture Appearance Transition Temperature (FATT) at the center of a typical 127 centimeter diameter forging is 90° C., and the steel is potentially subject to temper embrittlement after long duration service exposure of elevated temperature loading and cooling during startup/shutdown cycling. Because the FATT is above ambient (room) temperature, the rotor must be prewarmed to a temperature above the FATT during startup, and must be carefully decelerated and cooled during shutdown, to avoid overload of the rotor in a temperature range of brittleness. These special startup and shutdown procedures lead to higher capital and fuel costs, and reduced operating flexibility for the utility. Conventional 1%CrMoV steel has lower hardenability than desired, and is susceptible to formation of ferrite at the center of large pieces.

It would therefore be desirable to identify a material of construction for steam and gas turbine rotors that retains the previously established and highly desirable characteristics and properties of the 1%CrMoV family of steels, but which has a reduced FATT, is more resistant to degradation in the form of decreasing mechanical properties and the appearance of temper brittlement, has better hardenability, and permits an extended design life of the rotor. The present invention fulfills this need, and further provides related advantages.

SUMMARY OF THE INVENTION

The present invention provides a steel which has the favorable strength and creep resistance properties of conventional 1%CrMoV steel, but additionally has better toughness, reduced Fracture Appearance Transition Temperature (FATT), improved hardenability, and reduced susceptibility to temper embrittlement after extended use at elevated temperature. Thus, the new steel is more suited to use in thick sections such as those of rotors. The steel of the invention can be heat treated in a manner similar to that employed for 1%CrMoV steel, but other heat treatments can be employed to further improve the toughness of the steel. The steel of the invention is somewhat more expensive to produce than the conventional rotor steel, but yields substantially improved properties.

In accordance with an embodiment of the invention, a steel consists essentially of from about 0.20 percent to about 0.35 percent carbon, less than about 0.1 percent manganese, from about 1.5 percent to about 6.5 percent nickel, from about 0.8 percent to about 2.0 percent chromium, from about 0.9 percent to about 2.0 percent molybdenum, from about 0.1 percent to about 0.4 percent vanadium, from zero to about 0.07 percent columbium, less than about 0.12 percent silicon, less than about 0.006 percent phosphorus, no more than about 0.002 percent sulfur, less than about 0.005 percent antimony, less than about 0.010 percent arsenic, less than about 0.010 percent tin, less than about 0.10 percent copper, less than about 0.010 percent aluminum, balance iron totalling 100 percent, with all percentages by weight.

More generally, a steel consists essentially of from about 0.20 percent to about 0.35 percent carbon, less than about 0.1 percent manganese, from about 1.5 percent to about 6.5 percent nickel, from about 0.8 percent to about 2.0 percent chromium, from about 0.9 percent to about 2.0 percent molybdenum, from about 0.1 percent to about 0.4 percent vanadium, from zero to about 0.07 percent columbium, less than about 0.12 percent silicon, balance iron totalling 100 percent, with all percentages by weight.

This steel is processed to a finished turbine rotor by forging to a preform shape, preliminary heat treating, rough machining, final heat treating, final machining, and inspecting. The preferred preliminary heat treatment includes normalization at 1020° C. for ½ hour per inch of diameter, cooling, and tempering at about 680° C. for 10 hours to soften the steel for ease of machining. The preferred final heat treatment includes austenitizing at 954° C. for ½ hour per inch of diameter, fan air cooling or oil quenching, and tempering at 680° C. to a nominal tensile strength of 790 MPa. All heat treatments are normally conducted in suitably controlled furnaces that maintain the necessary heating and cooling rates, and temperatures. Such furnaces may be gas-fired, oil-fired, electric, or otherwise. The atmosphere of heat treatment depends somewhat upon the subsequent processing and the temperatures. Decarburization of the surface region is to be avoided, if that region is not to be removed by subsequent machining. In such instance, a slightly reducing or inert atmosphere is normally used. If there is to be subsequent machining to remove the surface, heat treating in air is acceptable.

More generally and in accordance with the invention, a turbine rotor comprises a steel consisting essentially of from about 0.20 percent to about 0.35 percent carbon, less than about 0.1 percent manganese, from about 1.5 percent to about 6.5 percent nickel, from about 0.8 percent to about 2.0 percent chromium, from about 0.9 percent to about 2.0 percent molybdenum, from about 0.1 percent to about 0.4 percent vanadium, from zero to about 0.07 percent columbium, less than about 0.12 percent silicon, balance iron totalling 100 percent, with all percentages by weight.

In accordance with the processing aspect of the invention, a process for preparing a steel turbine rotor comprises the steps of furnishing a starting material having a composition consisting essentially of from about 0.20 percent to about 0.35 percent carbon, less than about 0.1 percent manganese, from about 1.5 percent to about 6.5 percent nickel, from about 0.8 percent to about 2.0 percent chromium, from about 0.9 percent to about 2.0 percent molybdenum, from about 0.1 percent to about 0.4 percent vanadium, from zero to about 0.07 percent columbium, less than about 0.12 percent silicon, less than about 0.006 percent phosphorus, less than about 0.002 percent sulfur, less than about 0.005 percent antimony, less than about 0.010 percent arsenic, less than about 0.010 percent tin, less than about 0.10 percent copper, less than about 0.010 percent aluminum, balance iron totalling 100 percent, with all percentages by weight; heat treating the starting material; and forming the heat treated starting material into a turbine rotor. Individual substeps of the heat treating and forming steps may be, and typically are, intermixed, so that a heat treatment step may be followed by a forming step, which is then followed by another heat treatment step and another forming step. "Forming" is used herein in a broad sense, to include forging, machining, and other types of metalworking operations.

Particular compositions of the steel are preferred as having the most favorable combination of properties, and are favored in the fabrication of a turbine rotor. In accordance with one of the preferred compositions, a steel contains about 0.30 percent carbon, 0.02 percent manganese, about 0.02 percent silicon, about 0.001 percent phosphorous, about 0.001 percent sulfur, about 2.5 percent nickel, about 1.1 percent chromium, about 1.2 percent molybdenum, about 0.25 percent vanadium, and about 0.04 percent columbium.

In accordance with a second preferred embodiment, a steel contains about 0.30 percent carbon, 0.02 percent manganese, about 0.02 percent silicon, about 0.001 percent phosphorous, about 0.001 percent sulfur, about 2.5 percent nickel, about 1.5 percent chromium, about 1.4 percent molybdenum, and about 0.25 percent vanadium.

In accordance with a third preferred embodiment, a steel contains about 0.30 percent carbon, 0.02 percent manganese, about 0.02 percent silicon, about 0.001 percent phosphorus, about 0.001 percent sulfur, about 2.5 percent nickel, about 1.5 percent chromium, about 1.4 percent molybdenum, about 0.25 percent vanadium, and about 0.04 percent columbium.

In accordance with a fourth preferred embodiment, a steel contains about 0.23 percent carbon, 0.02 percent manganese, about 0.02 percent silicon, about 0.001 percent phosphorus, about 0.001 percent sulfur, about 2.5 percent nickel, and 1.5 percent chromium, about 1.4 percent molybdenum, about 0.25 percent vanadium, and about 0.04 percent columbium.

In these preferred embodiments, the amounts of the elements may vary with the steel production practice. Laboratory heats typically have lower amounts of minor elements as compared with production heats. For example, the amount of phosphorus in a production heat may be as high as 0.003 percent and still provide equivalent results.

In each of these preferred embodiments, the level of other elements is preferably, but not necessarily, maintained within particular limits. The most preferred variations of the four preferred embodiments, each steel has less than about 0.006 perecnt phosphorus, less than about 0.002 percent sulfur, less than about 0.005 percent antimony, less than about 0.010 percent arsenic, less than about 0.010 percent tin, less than about 0.10 percent copper, less than about 0.010 percent aluminum.

In the steel of the invention, the manganese content is maintained at a relatively low level of less than about 0.1 percent, to avoid the incidence of manganese-related temper embrittlement during extended elevated temperature exposure. A high nickel level is added to compensate for the low manganese content, thereby maintaining or increasing the hardenability of the steel and permitting a high level of toughness to be attained by lowering the bainite start temperature and thence the FATT. Silicon is also maintained at a low level to avoid temper embrittlement and the formation of silicate inclusions which would reduce the toughness of the steel. In some of the steels, columbium (also known as niobium) is added to reduce austenite grain size through the formation of columbium carbides that inhibit austenite grain growth, thus improving the creep resistance and toughness of the steel. Softening resistance is also imparted by the columbium addition. Other elements such as phosphorus, antimony, arsenic, tin are maintained at low levels to avoid temper embrittlement. The sulfur level is low to avoid formation of sulfides that could lead to hot shortness and reduced toughness. The copper and aluminum contents are low to maintain creep ductility at elevated temperatures. The bases for specific limits on these and other alloying additions will be discussed subsequently.

The steels of the invention thus achieve acceptable strength, creep, and toughness properties, while at the same time having improved resistance to degradation of these properties with extended elevated temperature exposure. The FATT can be lowered to below ambient temperature, so that special startup and shutdown procedures are not required, an important saving to the utilities. Also, larger diameter rotor forgings may be hardened throughout their thickness as a result of the improved hardenability of the steel of the invention, as compared with the conventional 1%CrMoV steel. Thus, the improved steel has sufficient hardenability for the production of 200 centimeter diameter rotors, whereas the hardenability of the conventional 1%CrMoV steel limits their size to about 120 centimeters maximum diameter. Other features and advantages of the invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

Figure 1:
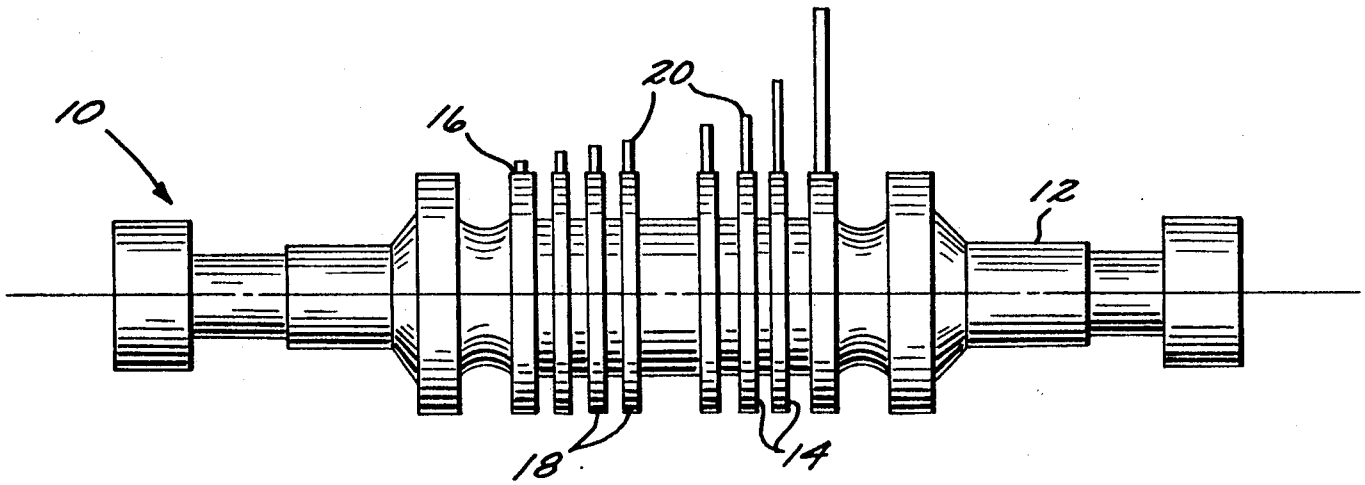
FIG. 1 is a perspective view of a forged steam turbine rotor shaft.

The steel of the invention is preferably used in the manufacture of turbine rotors, an example of which is illustrated in FIG. 1. (Many different configurations of rotos are used in different power plants, for high and low pressure service, or combined service, and FIG. 1 is meant only to be illustrative of the types of structure involved with the rotor and not any particular rotor.) A rotor 10 includes an integral shaft 12 and integral turbine disks 14. By way of example of the size of the rotor, the shaft length is typically from 250 to 500 centimeters, and the maximum diameter of the disks is typically from 80 to 200 centimeters. In operation, the shaft 12 turns on bearings (not shown). On the outer periphery 16 of the blade supports 14 are a plurality of attachment points 18, to which turbine blades 20 are attached (only a few of which are illustrated for the sake of clarity). Steam generated in a heat exchanger (not shown) is directed against the turbine blades 20, applying a tangential force to the rotor 10. The force causes the rotor 10 to turn on the bearings. This motion turns an electrical generator (not shown), resulting in the generation of electrical power.

When the rotor 10 is in service, it is heated by its surroundings and conduction of heat from the turbine blades 18, which are heated by the impinging steam. The rotor 10 turns in the bearings at a high rate, for example 3600 revolutions per minute (in United States practice). The resulting centrifugal forces create high radially outward loads in the rotor 10, which must be sustained for extended periods of time at elevated temperatures of as much a 565° C. Creep of the material in the rotor 10 would cause it to become distorted in shape, reducing its performance or even causing it to rub against its housing. A failure mechanism under these circumstances would be the initiation and propagation of a crack, causing a piece of the rotor to possibly separate and fly radially outwardly. If this were to happen, the remainder of the rotor would become unbalanced and tear out of the bearings, causing a failure of the entire turbine.

Under one past practice, the rotor has been constructed of a 1% CrMoV steel, whose composition has been previously discussed. Large ingots of the 1% CrMoV steel are heated, forged, preliminary heat treated, rough machined, further heat treated, and final machined to the shape generally illustrated in FIG. 1. This steel has proved highly effective in the manufacture of large turbine rotors, and rotors made of the steel are in use throughout the world. However, it is often possible to further improve even successful and useful materials, and the present invention provides such an improvement.

In the steel of the invention, the carbon content ranges from about 0.20 percent to about 0.35 percent by weight (all percentages herein are by weight, unless an indication to the contrary is stated). If the carbon content is below about 0.20 percent, the steel is expected to have insufficient creep strength and insufficient hardenability, especially in thick sections. The latter is an important consideration for steels used in thick sections such as rotors, because acceptable properties must be attained even at the center of a thick piece of steel. If the carbon content is above about 0.35 percent, the microstructure contains too high a volume fraction of carbides formed by reaction of the carbon with metallic elements such as chromium, molybdenum, vanadium, and columbium, present in the steel. The excessive fraction of carbides can assist in the premature initiation of cracks in the steel during loading, reducing its toughness, another important consideration for a steel that is to be used for long periods of loading at elevated temperature.

Particularly satisfactory steels have been identified as having as low as about 0.23 percent carbon and as high as about 0.30 percent carbon, and the most preferred range therefore falls between these limits. Steels having a carbon content from about 0.20 to about 0.23 percent carbon, and those having from about 0.30 to about 0.35 percent carbon, are acceptable, but not as desirable as those having from about 0.23 to about 0.30 percent carbon.

The manganese content of the steel of the invention is less than about 0.10 percent, and preferably less than about 0.05 percent. Most preferably, the manganese content is about 0.02 percent. Desirably, the content of manganese is as low as possible, but it is not generally possible to reach zero manganese in economical commercial production.

By contrast, the ASTM Specification A470 for 1% CrMoV steel permits as much as 1.0 percent manganese, and manganese contents of about 0.75 percent are commonly found in steels used in rotors. A word concerning the significance of the specification level for manganese, as well as other alloying additions, is appropriate. The specification is used in commercial melting practice as the limit to which the particular alloying element may be taken. Even though a specification range of "1.00 maximum" might be thought to overlap the range of 0–0.10 percent, those skilled in the art will recognize that the "1.00 maximum" specification in no way suggests or teaches the lower range, particularly when the reduction in manganese content is made to avoid a particular problem that may appear in steels lying in the higher range, and is made in combination with compensating changes in other alloying elements. The range of 1.00 maximum percent permits a melting practice in which the manganese can range up to 1.00 percent, at which levels there may be a significant incidence of temper embrittlement, as the present inventors have recognized. The lower range of zero to about 0.10 percent, as required by the present invention, drastically lowers the incidence of temper embrittlement, effectively creating a new material that is different in qualitative nature from the material produced according to the standard, prior specification.

The low level of manganese in the steel of the invention reduces the incidence of temper embrittlement of the steel, as compared with steels containing higher manganese contents. Temper embrittlement is a phenomenon observed in alloy steels wherein residual elements such as phosphorus can segregate to prior austenite grain boundaries during elevated temperature exposure or cooling from an elevated temperature, and lower their cohesive strength, thus embrittling the steel. Manganese has been identified by the present inventors as a contributor to temper embrittlement by both promoting the grain boundary segregation of residual elements such as phosphorus, as well as itself segregating to grain boundaries and causing their embrittlement. The level of manganese in the steel of the invention has therefore been drastically reduced as compared with prior 1% CrMoV steels. Manganese has beneficial effects upon the steel in avoiding hot shortness, contributing to hardenability, and reducing $B_s$ temperature, however, and its removal to low levels has not heretofore been possible without the loss of desirable features. As will be discussed, the types and levels of other alloying additions have been modified to compensate for the removal of manganese.

The silicon content of the present steel is less than about 0.12 percent, preferably less than about 0.05 percent, and most preferably about 0.02 percent. The silicon level is maintained at a low level to avoid the formation of silicate inclusions during steelmaking as well as contributing to the temper embrittlement process, and levels within the specified ranges have been found most effective in minimizing these problems. By contrast, levels of 0.15 to 0.35 percent are permitted by ASTM Specification A470, although levels below 0.10 percent are permitted by the specification when using vacuum carbon deoxidation. The prior steel and specification, however, do not teach the necessity of keeping the silicon level low. In the present case, vacuum deoxidation is preferably employed to avoid the need for silicon deoxidation.

The chromium content in the steel of the invention ranges from about 0.8 percent to about 2.0 percent, most preferably from about 1.1 percent to about 1.7 percent. If the chromium content is lower than about 0.8 percent, there is a significant loss in creep strength due to insufficient formation of carbides as well as a reduction of the solid solution strengthening effect of the chromium. If the chromium content is higher than about 2.0 percent, creep strength is lost due to the excessive formation of chromium-containing carbides, which reduces the of carbon available for the formation of finer vanadium-rich carbides, which improve creep strength.

The molybdenum content in the steel of the invention ranges from about 0.9 percent to about 2.0 percent, most preferably from about 1.2 percent to about 1.6 percent. The behavior of molybdenum is similar to that of chromium. If the molybdenum content is lower than about 0.9 percent, there is a significant loss in creep strength due to insufficient formation of carbides and reduced solid solution strengthening by molybdenum. If the molybdenum content is higher than about 2.0 percent, creep strength is lost due to the excessive formation of molybdenum-containing carbides, which similarly reduces the amount of carbon available for the formation of vanadium-rich carbides.

The nickel content of the steel of the invention is from about 1.5 percent to about 6.5 percent, most preferably about 2.5 percent. The inventors have established the following empirical relation for the temperature (degrees C.) at which the bainite reaction starts, $B_s$, as a function of the percentage content of carbon by weight (% C), percentage content of nickel by weight (% Ni), percentage content of chromium by weight (% Cr), and percentage content of molybdenum by weight (% Mo), during continuous cooling of the steel of the invention:

$$B_s(C.) = 692 - 217(\%\ C) - 32(\%\ Ni) - 25(\%\ Cr + \%\ Mo).$$

The lowest $B_s$ temperature acceptable for formation of bainite of the proper microstructure is observed to be about 400° C. By using this value of temperature, and the lower range values of carbon, chromium, and molybdenum, the upper value of nickel of about 6.5 percent is established. The top end of the $B_s$ temperature range which provides a suitable bainitic microstructure has been established to be about 500° C. By using 500° C. for the bainite start temperature and the top of the range values for carbon, chromium, and molybdenum, a lower value of nickel of about 0.5 percent is established.

The nickel content is used to adjust the bainite start temperature to achieve the most desirable type of microstructure, after the content of the other contributing alloying elements are established. A steel with a lower $B_s$ temperature exhibits a finer bainitic microstructure which provides better toughness than a steel with a higher $B_s$ temperature. Nickel has not been identified as causing the formation of damaging phases or depriving the material of critical elements needed for combination with other alloying elements. Thus, it can be readily demonstrated that an addition of nickel can compensate for a reduction of manganese in determining the $B_s$ temperature. In the steels of the invention, this "compensation" relation is such that the compensating addition of nickel must be about four times the reduction of manganese, when each element is expressed as a percentage by weight.

Although the $B_s$ calculation permits a minimum nickel content of about 0.5 percent, investigations reported in the Examples herein have established that a 0.9 percent nickel steel is unsuitable for turbine rotor fabrication. A steel with about 2.5 percent nickel has been successfully fabricated into a turbine rotor for testing. Laboratory test results indicate that a 1.5 percent nickel steel is satisfactory for turbine rotor applications, but has fracture toughness properties that are not as good as those of the preferred 2.5 percent nickel steel. In the judgment of the inventors, the steel for use in the turbine rotors must have at least about 1.5 percent nickel to have acceptable fracture toughness and fabricability.

The vanadium content is from about 0.1 percent to about 0.4 percent, preferably about 0.25 percent. Vanadium is an important alloying element, in that fine vanadium-rich carbides (or carbonitrides) formed during heat treatment provide creep strength to the steel. A steel containing less than about 0.1 percent vanadium will not be able to form a sufficient amount of vanadium-rich carbides to achieve acceptable creep strength. A steel containing more than about 0.4 percent vanadium has a high creep strength, but forms such a high volume fraction of vanadium-rich carbide that the toughness is unacceptably reduced.

Columbium (also known as niobium) is present in an amount of from 0 to about 0.07 percent, preferably from about 0.02 percent to about 0.07 percent, and most preferably about 0.04 percent. Columbium forms fine columbium carbides during heat treatment. The columbium carbides refine the austenitic grain structure of the steel, increasing its toughness and resistance to creep notch sensitivity. An absence of columbium results in the formation of no columbium carbide, while columbium in an amount of from 0 to about 0.02 percent forms a marginally small amount. A columbium content greater than about 0.07 percent results in the formation of eutectic columbium carbide as coarse particles during solidification, resulting in reduced toughness of the final product.

Several minor elements are known to contribute to temper embrittlement during extended exposure. Their levels are therefore maintained as low as possible, consistent with commercial practice, to avoid temper embrittlement. Phosphorus is limited to less than about 0.006 percent, antimony is limited to less than about 0.005 percent, arsenic is limited to less than about 0.010 percent, and tin is limited to less than about 0.010 percent.

The sulfur content of the steel is restricted to a low level, less than about 0.002 percent. The ASTM A470 specification permits as much as 0.015 percent sulfur, but in the present steel the sulfur content is held well below that amount. In conventional 1% CrMoV steels, the sulfur forms manganese sulfides, which are relatively harmless but can lead to reduced toughness. In the present steel, the manganese is largely removed, and the sulfur therefore would form an iron sulfide, unless the amount of sulfur is restricted. The presence of iron sulfide precipitates lead to hot shortness of the steel, a highly undesirable characteristic. To avoid the incidence of hot shortness, the sulfur is restricted to a much lower level than in conventional 1% CrMoV steels, due to the reduction of the manganese level. By maintaining the sulfur content at a very low level, fewer sulfide inclusions are formed, resulting in improved cleanliness of the steel. The sulfide inclusions can act as crack initiation sites and reduce toughness. Improved toughness is achieved when the sulfide volume fraction is reduced by lowering the sulfur content.

The copper content is maintained at less than about 0.10 percent, and the aluminum content is maintained at less than about 0.010 percent. Both copper and aluminum can have adverse effects on the creep ductility of the steel. Too high a content of either element, above the indicated limit, may lead to a significant loss of creep ductility, resulting in creep embrittlement.

Limitations placed on minor or residual elements are qualitatively significant to the nature of the steel. As stated in the immediately preceding paragraphs, the amounts of certain minor or residual elements are restricted in the present steel in order to achieve particular objectives. The maximum values disclosed for the prior steel, even though greater than the maximum values or ranges permitted by the present invention, do not foreshadow the present invention, where the prior practice extends the acceptable content of the elements to much higher amounts, without recognizing the significance and adverse effects of the higher amounts. Similarly, in normal practice, in the event that an element is not specified or not stated, those skilled in the art understand that there is no limitation placed on the amount of the element in steelmaking practice. This is an entirely different situation from that where specific limits are placed on the amount of the element permitted in the steel. Those skilled in the art recognize that failure to specify a limit, or quote a content of an element in a steel, suggests an absence of recognition of the importance of the element rather than a presumption that the content of the element is to be zero, absent a statement to the contrary.

The steels of the present invention are preferably used in the fabrication of rotors, as discussed previously. The following provides a preferred processing procedure, although other procedures are acceptable as long as they obtain similar results. A melted and cast ingot of the steel is forged to approximately the proper shape and size required for the final product, but is left oversize to accommodate rough and final machining.

Figure 2:
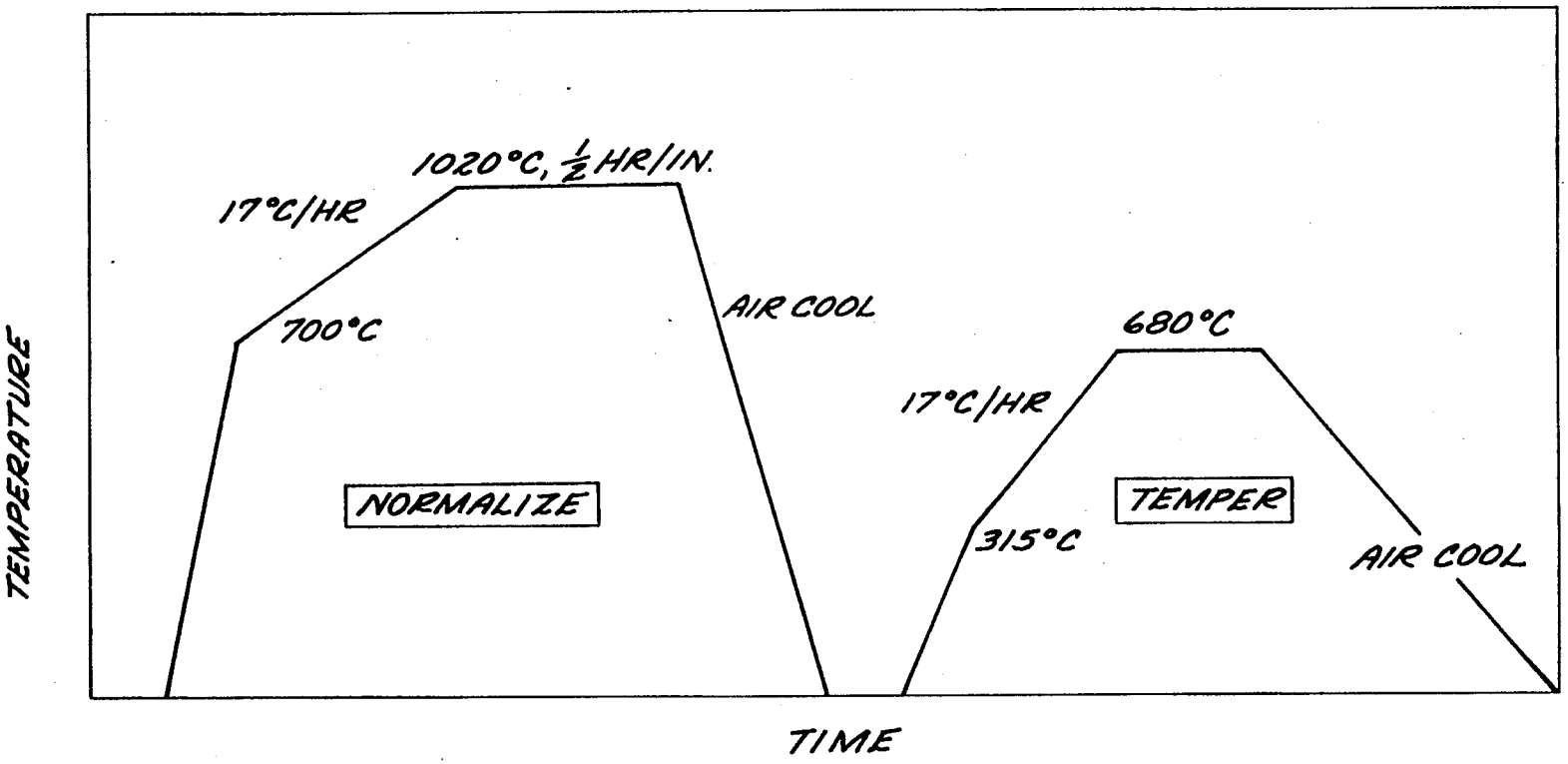
FIG. 2 is a graph of temperature versus time, illustrating the preferred preliminary heat treatment used in treating the preferred steel compositions.

The forged ingot (termed a "forging") is given a preliminary thermal treatment, as illustrated in FIG. 2. The temperatures in FIGS. 2 and 3, and discussed herein, are selected as representative of a typical acceptable commercial practice. The required soaking times, and heating and cooling rates (cooling medium) are applied to particular-sized forgings in the manner known to those skilled in the art. The steel is preferably normalized by heating the forging to 700° C., and then controllably heating the forging at a rate of about 17° C. per hour to a normalization temperature of 1020° C. The forging is maintained at 1020° C. for ½ hour per inch of diameter of the forging, and then air cooled. The normalized steel is tempered by heating it to about 315° C., and controllably heating the forging at a rate of about 17° C. per hour to 680° C., where it is maintained for several hours. The forging is air cooled to ambient temperature.

The normalized and tempered forging is rough machined as required.

Figure 3:
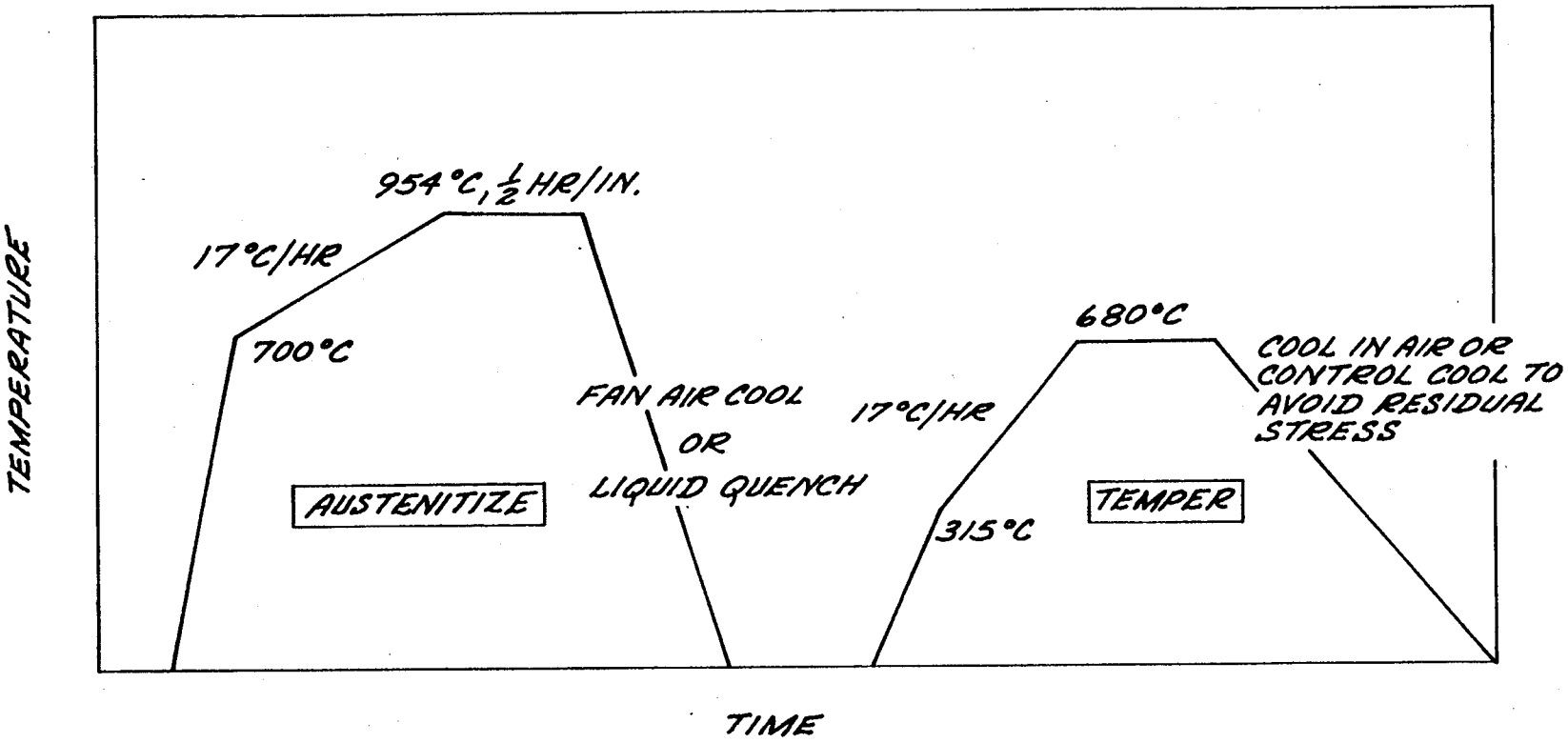
FIG. 3 is a graph of temperature versus time, illustrating the preferred final heat treatment used in treating the preferred steel compositions.

The forging is then heat treated by austenitizing and tempering, as schematically illustrated in FIG. 3. Again, the temperatures are those that would be chosen for commercial practice.

In austenitizing, the steel forging is preferably heated to 700° C., and then controllably heated at a rate of 17° C. per hour to an austenitizing temperature of 954° C., where it is maintained for ½ hour per inch of diameter. The forging is then cooled to ambient temperature. Normal commercial practice as presently used in the United States calls for fan cooling, producing a cooling rate of about 50° C. per hour at the center of a 127 centimeter diameter forging. The present steel may be cooled by oil quenching, the preferred process, which produces a cooling rate of about 117° C. per hous in the center of a 127 centimeter diameter forging. The oil cooled structure can produce properties superior to those of the fan cooled material. The steel may also be cooled by water quenching in a bath, spray, or the like, which produces a cooling rate of about 200° C. per hour in the center of a 127 diameter forging. Other quenching media are also acceptable.

The austenitized rotor is tempered by heating it to 315° C., and controllably heating it to 680° C. at a rate of 17° C. per hour. The steel is maintained at the tempering temperature to reduce its strength to a specific design limit, which is preferably about 790 MPa. The tempering time for the 127 centimeter diameter forging is about 25 hours. The tempered rotor is cooled to ambient temperature.

The rotor is final machined and inspected, and is ready for attachment of the turbine blades (which are separately produced).

One of the problems encountered with rotors produced from conventional 1% CrMoV steels is the requirement for slow and gradual startup and shutdown of the rotor in commerical service. This requirement stems from toughness limitations imposed by the steel. More specifically, a conventional 1% CrMoV steel tempered to a strength of 790 MPa has a 50% Fracture Appearance Transition Temperature (FATT) of 90° C., at the center of a 127 centimeter diameter forging. The FATT is a temperature accepted in the art to indicate the transition between generally more brittle behavior (below the FATT) and generally more ductile behavior (above the FATT). Since the 90° C. FATT is above ambient temperature, the rotor made of conventional 1% CrMoV steel is in a generally more brittle state at ambient or room temperature. If the rotor is started up under full power from a cold start, it may fail prematurely in the more brittle state. To avoid the possibility of such failures, the operating practice for such rotors requires a slow and prolonged heating to a temperature above the FATT, before a higher heating rate and higher stress operation is permitted. Similarly, when the rotor is shut down, a carefully controlled, prolonged cooling procedure is required at temperatures below the FATT. The imposition of these special startup and shutdown procedures is costly due to higher capital and fuel costs, and reduces flexibility of operation.

A major objective of the present invention is therfore to reduce the FATT of the steel to about ambient temperature, or to below ambient temperature. With this modification to the steel, the special startup and shutdown procedures for the rotor, to avoid high loading in the more brittle regime, is not required. Reduction of the FATT is essentially a modification of the hardenability and $B_s$ temperature of the steel, which modifications have been described above in relation to the effects of the various alloying elements, taken in combination. As indicated previously, it is not the effect of any one element and its compositional limitations that produces this improvement in FATT, but the effects in combination of the several alloying elements that work together to control the properties of the steel.

As will be seen in the following examples, the compositional limitations of the present steel permit the FATTs to be reduced to acceptably low temperatures.

The following examples are intended to illustrate aspects of the invention, and should not be taken as limiting of the invention in any respect.

EXAMPLE 1

A steel was prepared having the following composition: 0.30 percent carbon, 0.02 percent manganese, 0.02 percent silicon, 0.001 percent phosphorus, 0.001 percent sulfur, 2.50 percent nickel, 1.50 percent chromium, 1.40 percent molybdenum, and 0.25 percent vanadium, 0.0005 percent antimony, 0.001 percent arsenic, 0.002 percent tin, balance iron plus conventional amounts of impurity elements. The steel was prepared as a 225 kilogram vacuum induction melt, cast into an ingot mold, and hammer forged to a plate measuring 3.5 centimeters thick and 15.0 centimeters wide. The plates were given the preferred thermal treatments of normalizing and tempering (FIG. 2, and described above) and austenitizing and tempering to a nominal strength of 790 MPa (FIG. 3, and described above), under simulated fan cooling conditions of a cooling rate of about 50° C. per hour from the austenitizing temperature. The FATT of this steel was measured to be 27° C., which is approximately ambient temperature. The bainite start temperature was reduce due to the alloying additions, resulting in improved toughness and the reduced FATT. The creep rupture strength of the steel was superior to that of conventional 1% CrMoV steels.

EXAMPLE 2

Example 1 was repeated, except that simulated oil quenching, at a cooling rate of about 117° C. per hour from the austenitizing temperature, was used during austenitizing and tempering. The FATT was measured as 2° C.

EXAMPLE 3

Example 1 was repeated, except that the following elements were present in the indicated amounts: 1.10 chromium rather than 1.50 chromium as in Example 1, 1.20 molybdeum rather than 1.40 molybdenum as in Example 1, and columbium was present in an amount of 0.04 percent. The FATT of this steel was measured to be 49° C., significantly better than the FATT of conventional 1% CrMoV steels, but still above ambient temperature. The presence of the columbium is observed to reduce the austenitic grain size, resulting in improved toughness of the steel. The creep rupture strength of the steel is superior than that of the conventional 1% CrMoV steel. This steel was tested for temper embrittlement by exposing it to a temperature of 480° C. for over 10,000 hours, and was found to be without incidence of temperature embrittlement.

EXAMPLE 4

Example 3 was repeated, except that the chromium content was increased to 1.50 percent and the molybdenum content was increased to 1.40 percent. The FATT for this steel was measured as 4° C., well below ambient temperature. This steel exhibited creep rupture strength comparable with that of conventional 1% CrMoV steel.

EXAMPLE 5

Example 4 was repeated, except that the carbon content was decreased to 0.23 percent, from 0.30 percent, and the simulated oil quenching processing was used (as described in relation to Example 2). The FATT was measured as 21° C., below ambient temperature. This steel exhibited creep rupture strength in excess of that of conventional 1% CrMoV steel.

EXAMPLE 6

Example 1 was repeated, except that the nickel content of the steel was reduced to 1.54 percent and columbium in an amount of 0.04 percent was added. The FATT was 54° C.

EXAMPLE 7

Example 2 was repeated, except that the nickel content of the steel was reduced to 1.54 percent and columbium in an amount of 0.04 percent was added. The FATT was 48° C.

EXAMPLE 8

Example 2 was repeated, except that the carbon content of the steel was reduced to 0.21 percent, the nickel content of the steel was reduced to 1.54 percent, and columbium in an amount of 0.04 percent was added. The FATT was 52° C.

EXAMPLE 9

A steel was prepared with the composition set forth in Example 1, except having 0.27 percent carbon, 0.003 percent phosphorus, and 0.9 percent nickel. The steel was processed and forged into a turbine rotor blank having a cylindrical diameter of 1072 millimeters. The blank was cut into three cylindrical pieces. After austenitizing the blanks, one piece was fan air cooled to ambient temperature, one piece was oil quenched, and one piece was water spray quenched. The water spray quenched piece cracked radially on its flat bottom, probably due to a high FATT. This steel composition was judged too susceptible to cracking to be used for the fabrication of turbine rotors.

EXAMPLE 10

A steel was prepared having the composition set forth in Example 1, except having 0.25 percent carbon, 1.6 percent chromium, 0.003 percent phosphorus, and 1.2 percent molybdenum. This 2.5 percent nickel steel was processed and forged into a turbine rotor blank having a cylindrical diameter of 1750 millimeters. After austenitizing, the turbine rotor was successfully water spray quenched. The 2.5 percent nickel steel was judged acceptable for fabrication of turbine rotors.

The steel of the invention provides an important advance in the art, particularly for steels used in rotors of steam and gas turbines. These steels have acceptable strength and ductility properties, and good creep and toughness properties, at elevated temperature. They are resistant to degradation by temper embrittlement. Significantly, their FATTs are reduced below those of prior 1% CrMoV rotor steels, meaning that rotors produced using the steels of the invention need not undergo the extensive startup and shutdown procedures required of the prior rotors. Altough particular embodiments of the invention have been described in detail for purposes of illustration, various modifications may be made without departing from the spirit and scope of the invention. Accordingly, the invention is not to be limited except as by the appended claims.

What is claimed is:

1. A steel consisting essentially of from about 0.20 percent to about 0.35 percent carbon, less than about 0.1 percent manganese, from about 1.5 percent of about 6.5 percent nickel, from about 0.8 percent to about 2.0 percent chromium, from about 0.9 percent to about 2.0 percent molybdenum, from about 0.25 percent of about 0.4 percent vanadium, from zero to about 0.07 percent columbium, less than about 0.12 percent silicon, balance iron totalling 100 percent, with all percentages by weight.

2. A steel according to claim 1, containing about 0.30 percent carbon, 0.02 percent manganeses, about 0.02 percent silicon, about 0.001 percent phosphorus, about 0.001 percent sulfur, about 2.5 percent nickel, about 1.1 percent chromium, about 1.2 percent molybdenum, about 0.25 percent vanadium, and about 0.04 percent columbium.

3. A steel according to claim 1, containing about 0.30 percent carbon, 0.02 percent manganese, about 0.02 percent silicon, about 0.001 percent phosphorus, about 0.001 percent sulfur, about 2.5 percent nickel, about 1.5 percent chromium, about 1.4 percent molydbenum, and about 0.25 percent vanadium.

4. A steel according to claim 1, containing about 0.30 percent carbon, 0.02 percent manganese, about 0.02 percent silicon, about 0.001 percent phosphorus, about 0.001 percent sulfur, about 2.5 percent nickel, about 1.5 percent chromium, about 1.4 percent molybdeum, about 0.25 percent vanadium, and about 0.04 percent columbium.

5. A steel according to claim 1, containing about 0.23 percent carbon, 0.02 percent manganese, about 0.02 percent silicon, about 0.001 percent phosphorus, about 0.001 percent sulfur, about 2.5 percent nickel, about 1.5 percent chromium, about 1.4 percent molybdenum, about 0.25 percent vanadium, and about 0.04 percent columbium.

6. A steel, consisting essentially of from about 0.20 percent to about 0.35 percent carbon, less than about 0.1 percent manganese, from about 1.5 percent to about 6.5 percent nickel, from about 0.8 percent to about 2.0 percent chromium, from about 0.9 percent to about 2.0 percent molybdeum, from about 0.25 percent to about 0.4 percent vanadium, from zero to about 0.07 percent columbium, less than about 0.12 percent silicon, less than about 0.006 percent phosphorus, no more than about 0.002 percent sulfur, less than about 0.005 percent antimony, less than about 0.010 percent arsenic, less than about 0.010 percent tin, less than about 0.10 percent copper, less than about 0.010 percent aluminum, balance iron totalling 100 percent, with all percentages by weight.

7. A steel, consisting essentially of form about 0.2 percent to about 0.3 percent carbon, less than about 0.1 percent manganese, about 2.5 percent nickel, from about 1.1 percent to about 1.7 percent chromium, from about 1.2 percent to about 1.6 percent molybdenum, about 0.25 percent vanadium, from zero to about 0.04 percent columbium, less than about 0.12 percent silicon, balance iron, with all percentages by weight.

8. A steel according to claim 7, wherein the steel has less than about 0.006 percent phosphorus, no more than about 0.002 percent sulfur, less than about 0.005 percent antimony, less than about 0.010 percent arsenic, less than about 0.010 percent tin, less than about 0.10 percent copper, and less than about 0.010 percent aluminum.

9. A turbine rotor comprising a steel consisting essentially of form about 0.20 percent to about 0.35 percent carbon, less than about 0.1 percent manganese, from about 1.5 percent to about 6.5 percent nickel, from about 0.8 percent of about 2.0 percent chromium, from about 0.9 percent to about 2.0 percent molybdenum, from about 0.25 percent to about 0.4 percent vanadium, from zero to about 0.07 percent columbium, less than about 0.12 percent silicon, balance iron, with all percentages by weight.

10. The rotor of claim 9, wherein the steel has an austenitized, quenched, and tempered microstructure.

11. The rotor of claim 9, wherein the steel has less than about 0.006 percent phosphorus, no more than about 0.002 percent sulfur, less than about 0.005 percent antimony, less than about 0.010 percent arsenic, less than about 0.010 percent tin, less than about 0.10 percent copper, and less than about 0.010 percent aluminum.

12. A process for preparing a steel turbine rotor, comprising the steps of:

furnishing a starting material having a composition consisting essentially of from about 0.20 percent to about 0.35 percent carbon, less than about 0.1 percent manganese, from about 1.5 percent to about 6.5 percent nickel, from about 0.8 percent to about 2.0 percent chromium, from about 0.9 percent to about 2.0 percent molybdenum, from about 0.25 percent to about 0.4 percent vanadium, from zero to about 0.07 percent columbium, less than about 0.12 percent silicon, balance iron, with all percentages by weight;

heat treating the starting material; and forming the heat treated starting material into a turbine rotor.

13. The process of claim 12, wherein the steel has less than about 0.006 percent phosphorus, no more than about 0.002 percent sulfur, less than about 0.005 percent antimony, less than about 0.010 percent arsenic, less than about 0.010 percent tin, less than about 0.10 percent copper, and less than about 0.010 percent aluminum.

14. The process of claim 12, wherein the starting material has a composition consisting essentially of from about 0.2 percent to about 0.3 percent carbon, less than about 0.1 percent manganese, about 2.5 percent nickel, from about 1.1 percent to about 1.7 percent chromium, from about 1.2 percent to about 1.6 percent molybdenum, about 0.25 percent vanadium, from zero to about 0.04 percent columbium, and less than about 0.12 percent silicon.

15. The process of claim 12, wherein the step of heat treating includes the steps of austenitizing, quenching, and tempering the rotor.

16. The process of claim 15, wherein the rotor is cooled from the austenitizing temperature so that the cooling rate at the center of the forging in the step of quenching is from about 50° C. to about 200° C. per hour.

17. The process of claim 12, further including the step of forming the starting material; after the step of furnishing and before the step of heat treating.

18. A steel according to claim 1, wherein the manganese content is less than about 0.05 percent.

19. A steel according to claim 1, wherein the sulfur content is no more than about 0.002 percent.

* * * * *